United States Patent [19]

Brinlee

[11] Patent Number: 5,020,407

[45] Date of Patent: Jun. 4, 1991

[54] ADJUSTABLE FORM TOOL HEAD

[76] Inventor: Charles P. Brinlee, 205 E. Harmon, #709, Las Vegas, Nev. 89109

[21] Appl. No.: 450,269

[22] Filed: Dec. 13, 1989

Related U.S. Application Data

[63] Continuation-in-part of Ser. No. 194,825, May 17, 1988, abandoned.

[51] Int. Cl.[5] ..... B26F 1/14

[52] U.S. Cl. ..... 83/530; 83/686; 83/700

[58] Field of Search ..... 83/588, 640, 698, 699, 83/700, 686, 530

[56] References Cited

U.S. PATENT DOCUMENTS

| | | | |
|---|---|---|---|
| 1,834,918 | 12/1931 | Altvater | 83/699 |
| 2,364,401 | 12/1944 | Stellin | 83/690 |
| 2,798,553 | 7/1957 | Berdan | 164/86 |
| 3,122,044 | 2/1964 | Grosh | 83/588 |
| 3,926,082 | 12/1975 | von Langendorff | 83/700 |
| 3,935,771 | 2/1976 | Cady, Jr. | 83/698 |
| 4,141,264 | 2/1979 | Weisbeck | 83/700 |
| 4,144,785 | 3/1979 | von Langendorff | 83/685 |
| 4,375,774 | 3/1983 | Wilson et al. | 83/700 |
| 4,440,052 | 4/1984 | Weisbeck | 83/640 |
| 4,457,196 | 7/1984 | Cady | 83/640 |
| 4,692,073 | 9/1987 | Martindell | 408/239 A |

*Primary Examiner*—Hien H. Phan

*Attorney, Agent, or Firm*—Quirk, Tratos & Roethel

[57] ABSTRACT

A form tool built to be used in a single station of a turret press machine for the sheet metal industry that comprises a punch body rigidly attached to an adjustable form tool head. The adjustable form tool head is quickly adjustable for different forming operations and for different material thickness. The depth of the forming or shaping operation is determined by the length of the punch head. This length is adjusted by lifting a spring loaded outer collar that is keyed to a hardened threaded punch driver. The length is increased or decreased by rotating the punch driver in a clockwise or counterclockwise direction. The adjustment is made in small increments and permanently locked when the spring loaded collar is released and seated on two locking pins located on the punch head base.

6 Claims, 1 Drawing Sheet

ADJUSTABLE FORM TOOL HEAD

CROSS REFERENCE TO RELATED APPLICATION

This is a continuation-in-part of copending application Ser. No. 07/194,825 filed on May 17, 1988, now abandoned.

BACKGROUND OF THE INVENTION

The present invention relates to a form tool head and more particularly to a form tool head having an improved adjusting mechanism for varying the depth of the punching or stamping done by the punch press.

Form tools are used in single station or turret press machines. Form tools must be set up to the machine's punching stroke and the thickness of the material on which the punching or forming operation is to be performed. The set up of a form tool in a press is critical. Almost all problems with forming tools occur during set up Incorrectly setting the height of a form tool during set up can damage the tool and possibly the press. If the height of the form tool moves during a punching operation (after initial set up), for example, damage to the form tool and scrapped parts will likely be the result.

The setting of the tool length can be a tedious and time consuming process beginning with the loosening of set screws which conventionally have been used for locking an internally threaded tool head to a threaded shaft of a punch tool. Next the form tool head must be turned in a clockwise or counter-clockwise direction to move the tool head along the threaded shaft of the form tool to increase or decrease the tool length as required. Then the loosened set screws must be tightened to lock the form tool head in place against the shaft of the form tool. The loosening and tightening of the set screws may have to be repeated several times to achieve the precise adjustment of the form tool length required.

The tool head used in modern high speed presses is subjected to large repetitious forces during the operation of the machine. The set screws may tend to work loose and the threads of the threaded shaft or head may become damaged or even stripped causing the tool's height or length to change midway through the production cycle. The value of the lost production, scrap material produced and damage to the press would be shockingly high. The inherent disadvantages that result from the use of set screws for locking the form tool head in adjusted position are also common to other locking devices such as clips or keys which can work loose.

It is an object of the present invention to provide a form tool head incorporating a mechanism for quickly and accurately making length adjustments of the form tool head.

It is a further object to provide an adjustment mechanism that achieves a positive lock of the length of the tool so that the height of the tool cannot change midway through a production run.

It is yet a further object of the present invention to substantially reduce the effort and time required to adjust a form tool's length to a press machine's punching stroke and the thickness of the material.

It is yet a further object of the present invention to provide a form tool head having an adjustment mechanism that permits the length of the tool to be quickly adjusted in small movement increments until the length is brought to an accurate working tolerance.

It is yet a further object to achieve a positive lock of the form tool head length without the use of set screws, clips or keys.

It is yet a further object to provide an adjustment mechanism that permits the form tool head length adjustments to be done easily while the tool remains in the press. With larger station tools weighing from 14 to 28 pounds, the ability to make adjustments with the form tool head in the press results in a substantial saving in machine down time.

SUMMARY OF THE INVENTION

According to the present invention, a form tool head adapted for engagement with the body of a form tool comprises a punch head base adapted to be rigidly connected with the body of the form tool, a punch driver which engages with the punch head base and which is adjustable longitudinally relative to the punch head base to establish the overall length of the form tool head, a length control member which engages with but is movable longitudinally relative to the punch drive and which is adapted to engage with locking pins disposed on the punch head base, and a biasing element for holding said length control member in engagement with the locking pins.

In a preferred embodiment, the form tool head has a threaded portion extending from its base so that it can be rigidly secured to the body of the form tool. The punch head base has at the end remote from the threaded portion a threaded cavity adapted to receive a threaded end of a punch driver, rotation of which results in the punch driver moving longitudinally relative to the punch head base thereby altering the overall length of the form tool head.

A length control member is slidably mounted intermediate the punch head base and punch driver. Preferably it is in the form of an annular collar having an ovular central aperture that is adapted to engage and grip a like-shaped intermediate portion of the punch driver so that, in an adjusting position, movement of the collar in a clockwise or counter-clockwise direction will result in the longitudinal displacement of the punch driver toward or away from the punch head base, thereby altering the length of the form tool head.

Preferably the collar has a plurality of spaced holes thereon adapted to engage with a plurality of locking pins on the punch head base. When the form tool is in use, a biasing member in the form of a compression spring functions to hold the collar in engagement with the locking pins. . . . .

BRIEF DESCRIPTION OF THE DRAWINGs

A specific embodiment of the present invention will now be described, by way of example only, with reference to the accompanying drawings, in which.

DESCRIPTION OF THE PREFERRED EMBODIMENT

Figure 1:
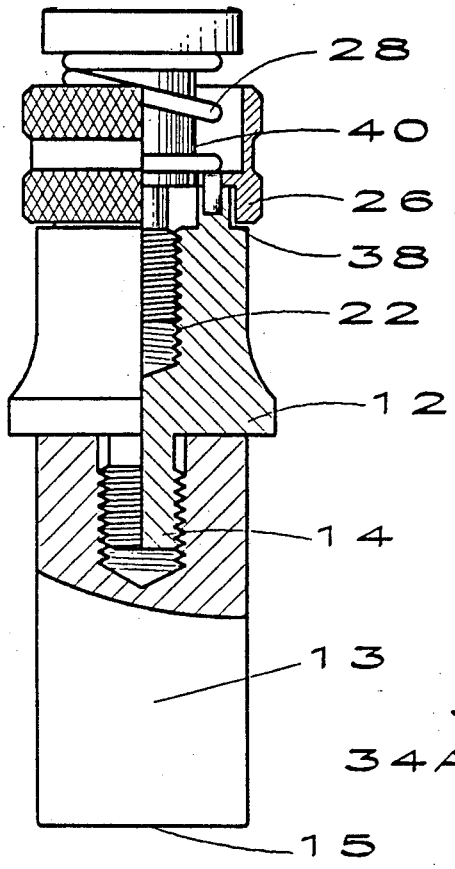
FIG. 1 is a side elevation in partial cross section of a form tool head in accordance with the present invention.
Figure 2:
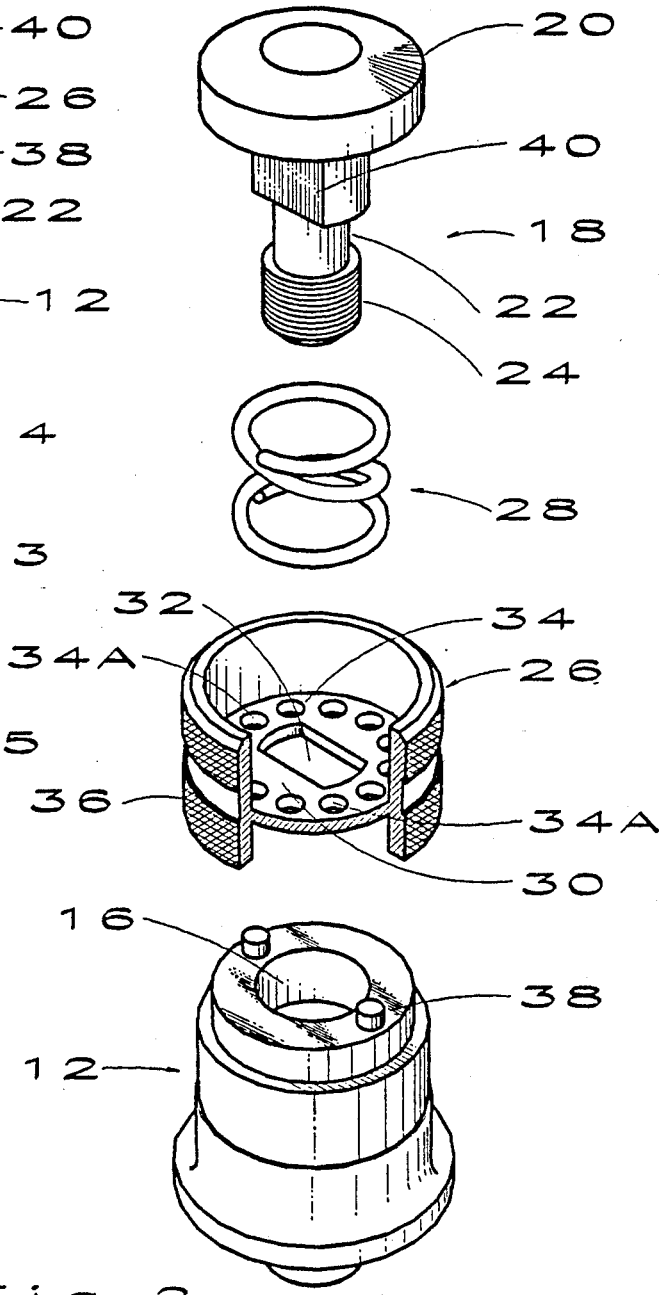
FIG. 2 is an exploded view of the form tool head of the present invention shown in FIG. 1.

The form tool head 10 comprises a punch head base 12 having a threaded portion 14 for attachment of the punch head base 12 to a form tool body 13. On its lower end 15, the form tool body is adapted to carry various form tools (not shown) for punching apertures, adding stiffening ribs or louvers or for performing dozens of other forming operations in sheet metal. The punch head base 12 has a central internal recess 16 which is threaded at 17 and it is by means of this recess 16 that a punch driver 18 is connected to the punch head base 12.

The punch driver 18 is made of hardened steel and is of a generally mushroom shaped configuration. It has a substantially convex head 20 from the underside of which extends a solid cylindrical shaft 22 which is threaded at its lower end 24. It is the lower end 24 of this shaft 22 that engages and cooperates with the threads 17 in the punch head base 12.

By rotating the punch driver 18 clockwise or counter-clockwise, the punch driver 18 can be made to move up or down relative to the punch head base 12. This up or down movement determines the resulting overall length of the form tool head 10.

Intermediate the punch head base 12 and the punch driver 18 lies the length control member 26 and a compression spring 28. The length control member 26 is in the form of a generally circular collar comprising an annular disc 30 having a generally ovular central aperture 32 and twelve small generally circular apertures 34 equally spaced along the circumference of the annular disk 30. The outside surface of the length control member 26 comprises a raised outer wall 36 which is knurled or roughened to aid manual gripping of the length control member.

The length control member 26 is movable longitudinally by a sliding action between a first and second position.

In a first position, the length control member 26 sits on the punch head base 12 such that two diametrically opposed apertures 34A of the twelve apertures 34 sit on two diametrically opposed pins 38 formed on and projecting from the uppermost surface of the punch head base 12. In this position the ovular central aperture 32 is also in contact with and grips a complementary ovular section 40 formed on the upper part of the shaft 22 of the punch driver 18, such that the punch driver 18 is keyed to the collar 26 and is prevented from turning until the collar is moved to a second position by sliding it longitudinally so that the collar is disengaged from the pins 38 of the punch head base 12.

In the first position, the compression spring 28 holds the collar 26 down so that the diametrically opposed apertures 34A of the collar engage with the two pins 38 of the punch head base.

To adjust the length of the form tool head 10, the collar 26 is slid upwardly to a second position so that the collar 26 disengages from the pins 38 on punch head base 12 and is thus free to rotate. Since the ovular central aperture 32 is in contact with and grips the ovular section 40 of the punch driver 18, rotation of the collar 26 results in rotation of the punch driver 18 thereby moving the punch driver 18 longitudinally relative to the punch head base 12. Compression spring 28 functions to bias the collar 26 downwards towards the base 12, so that on release of the collar 26, the collar comes back into contact with the punch head base 12 by engaging two diametrically opposed apertures 34 in the annular disk 30 with the two pins 38 of the punch head base 12. Since the ovular section 40 of the punch driver 18 and the central aperture 32 of the collar 36 are also locked together, the punch driver 18 is effectively locked in a set position relative to the punch head base 12.

In use, the action of the downward bias exerted by the compression spring 28 prevents the length control member 26 from disengaging the punch head base 12 thereby preventing any accidental disengagement and any accidental changing of the length of the form tool head 10.

To begin set up of any forming operation, the tool must first be adjusted to its shortest length. The tool next is loaded into a press, such as a model #FC-1000 made by Strip-pit, Inc. and a single stroke (hit) of the press made onto the sheet metal. From examining the sheet metal, the operator can then make an adjustment in the tool height. By repeating these steps, the form is brought to tolerance. The use of the pin and aperture system of the present invention enables adjustment steps of as little as 0.002" (one-twelfth of the pitch of the screw thread) to be made using a collar 36 having twelve apertures 34 on an annular disk 30. With larger station tools weighing from 14 to 28 pounds, the ability to make adjustments with the form tool head in the press results in a substantial saving in press down time.

The present invention should be no way limited to the embodiment described and it is to be understood that other mechanical equivalents are hereby incorporated, for example the collar could have male mating parts thereon and the base female mating parts.

I claim:

1. A form tool head assembly, comprising:

a punch head base adapted to be rigidly coupled to a form tool body, a punch driver having a capped head on its upper end and a threaded portion on its lower end with the threaded portion being threadable into a threaded bore in the punch head base to a variable depth, a length control member mounted on the punch driver intermediate the punch head base and the capped head portion of the punch driver, the length control member comprising an annular collar having a central aperture through which the punch driver projects, the annular collar aperture being shaped to slidably and non-rotatably fit over a complementary portion of the punch driver beneath the capped head of the latter, whereby rotation of the annular collar in clockwise or counterclockwise directions will result in threaded longitudinal movement of the punch driver relative to the punch head to either shorten or lengthen the length of the form tool head assembly depending on the chosen direction of rotation, the annular collar having a first position on the punch driver in which it is operable to cause punch driver longitudinal adjustment movement and a second position on the punch driver in which it locks the punch driver against longitudinal adjustment movement.

2. A form tool head assembly according to claim 1, in which:

the annular collar includes an integral disk having a plurality of circularly spaced apertures engageable with locking pins on the punch head base, and a biasing means for holding the annular collar in the second position is interposed between the collar and the punch driver capped head portion to hold the collar down on the locking pins to maintain the adjusted position of the form tool head assembly.

3. A form tool head assembly according to claim 2, in which:

the biasing means is a compression spring, the compression spring being yieldable to a lifting force applied to the annular collar to lift the same upwardly to the first position in which it is operable to cause longitudinal adjustment movement of the punch driver.

4. A form tool head assembly according to claim 2, in which:

the annular collar disk has twelve circumferentially equally spaced apertures opposite pairs of which are engageable with two diametrically opposed locking pins on the punch head base permitting step-by-step length adjustment to be made to the form tool head assembly, the length adjustment can amount to as little as 0.002 of an inch or one-twelfth of the pitch of the screw thread on the punch driver.

5. An improved form tool head assembly having a punch head rigidly connected to a form head body, wherein the improvement comprises:

a quick adjustment mechanism providing for different forming operations and for different material thicknesses in which the tool length is determined by the punch driver stroke required to perform the desired forming operation, the quick adjustment mechanism including a spring-loaded outer collar that is keyed to a hardened threaded punch driver portion that is threaded into a cavity in a punch base, the tool length being adjustable by lifting the collar off locking pins on the punch head base against the bias of the spring load on the collar, the lifted collar then being turnable in either direction to make up or down adjustments of the punch driver relative to the punch head base in small increments, the adjustment being permanently locked in place when the lifting force on the spring-loaded collar is released and the annular collar is seated on the locking pins located on the punch head base.

6. An improved form tool head assembly according to claim 5, in which:

the collar has an annular disk portion having twelve apertures arranged in a circle, and the punch head base has two diametrically opposed locking pins thereon, opposite pairs of the apertures being selectively engageable with the locking pins wherein the tool length adjustments may be made in increments of one-twelfth of the pitch of the screw thread on the punch driver.

* * * * *